United States Patent [19]

Nikitits et al.

[11] 3,994,527

[45] Nov. 30, 1976

[54] COMBINED FOLDING TABLE AND SEAT ASSEMBLY

[75] Inventors: Edwin Nikitits, Lachine; Jean Guy Demers, Outremont, both of Canada

[73] Assignee: Franklyn M. Markus, Cote St. Luc, Canada

[22] Filed: Oct. 24, 1975

[21] Appl. No.: 625,695

[52] U.S. Cl. ..... 297/159; 297/139; 108/35

[51] Int. Cl.[2] ..... A47B 39/00

[58] Field of Search ..... 297/159, 141, 139, 157; 108/35, 36

[56] References Cited

UNITED STATES PATENTS

| | | | |
|---|---|---|---|
| 1,272,187 | 7/1918 | Basford | 297/159 |
| 1,514,418 | 11/1924 | Battenfeld | 297/159 |
| 1,594,572 | 8/1926 | Soltesz | 297/139 |
| 1,641,010 | 8/1927 | Peterson | 297/139 X |
| 1,716,612 | 6/1929 | Wing | 297/139 X |
| 2,217,576 | 10/1940 | Weber | 297/139 |
| 2,558,465 | 6/1951 | Seymour | 297/121 X |
| 2,647,562 | 8/1953 | Hoffar | 297/139 |
| 2,991,829 | 7/1961 | Post | 297/139 |
| 3,141,424 | 7/1964 | Seymour | 297/159 X |
| 3,256,037 | 6/1966 | Giambalvo | 297/159 |

FOREIGN PATENTS OR APPLICATIONS

| | | | |
|---|---|---|---|
| 988,168 | 8/1951 | France | 297/139 |
| 1,092,230 | 4/1955 | France | 297/139 |

*Primary Examiner*—Roy D. Frazier
*Assistant Examiner*—Peter A. Aschenbrenner
*Attorney, Agent, or Firm*—Hubbell, Cohen, Stiefel & Gross

[57] ABSTRACT

A collapsible combined table and seat assembly including an improved collapsible linkage for rigidly supporting the seats and for supporting the table on the seats. The linkages rely on knock down rigided triangular structures, one for supporting each seat and one extending between the seats and the table top.

28 Claims, 16 Drawing Figures

COMBINED FOLDING TABLE AND SEAT ASSEMBLY

BACKGROUND OF THE INVENTION

1. Field of the Invention

This invention relates to a combined folding table and seat assembly and particularly to a combined folding table and seat assembly that is collapsible into a self-contained carrying case comprised of the table top. Most particularly, this invention relates to a combined folding table and seat assembly which is collapsible into a case comprised of a folding table top, which assembly, when folded, is readily portable and storable in the trunk of an automobile, or a closet or the like.

2. The Prior Art

As the society has become increasingly mobile through the greatly expanded use of the automobile, more and more families seek to picnic along the side of a road or in a secluded spot. While, often times, prepared picnic facilitiess are provided, these are generally crowded and are commonly located at sites that are cultivated. Many people prefer to picnic by themselves in more natural surroundings where no dining facilities are available. Also, one often finds no permanent picnic facility at the time he wishes to eat. This generally leads to the use of a picnic blanket or the like which is uncomfortable and often untidy. Thus, there is a growing need for a portable dining facility in the form of a collapsible table and chair assembly.

A similar need has arisen in schools and other public facilities such as conference rooms which use unstructured classroom arrangements. In such arrangements, it is often desirable to clear a room entirely of tables and chairs for certain school activities. To remove standard classroom desks and chairs is an impractical solution to that problem and thus a need for a collapsible chair and desk has arisen.

The need for lightweight and durable collapsible tables and chairs has been recognized for a long time. Thus, for example, in Bassford U.S. Pat. No. 1,272,187 granted on July 9, 1918, a collapsible combined table and seats is disclosed. This Bassford assembly was, by virtue of the nature of the collapsing movements of the various components, relatively large in its collapsed condition. Moreover, there are a number of detachable elements which must be disconnected before collapse is effected and must be connected when operating it to its open position. In U.S. Pat. No. 1,514,418 granted to J. N. Battenfield on Nov. 4, 1924, a combined folding table and seat is disclosed which includes a complex collapsible linkage that is necessarily of substantial weight if it is to have adequate rigidity. Moreover, during the assembly and disassembly of the Battenfield structure, a variety of elements must be disconnected from one another. In the Peterson U.S. Pat. No. 1,641,010, a collapsible table or chair or seat arrangement is disclosed. This arrangement however has a multiplicity of detached separate parts which must be joined to assemble the assembly. This is not convenient and is time consuming. Moreover, because of the number of separate joints in the Peterson device, it is difficult to make such a device rigid without utilizing heavy costly parts. Similarly, in the patent granted to L. Wing on June 11, 1929, U.S. Pat. No. 1,716,612, a collapsible combined table and seat is disclosed. However, the nature of the support of the table on the seats is such as to render the structure somewhat unstable. In Soltesz U.S. Pat. No. Re. 18,207 granted Sept. 22, 1931 still another collapsible combined table and seat is disclosed. This structure requires complex toggle linkages and numerous separate operations for assemblying and disassemblying for combined assembly. Also, the structure precludes access from the sides of the seat, thereby rendering it inconvenient in use. On Oct. 8, 1940, a patent was granted to F. Weber, U.S. Pat. No. 2,217,576, which patent is directed to a collapsible folding table and seat. This device requires complex sliding linkages which would prove to be heavy and costly. In U.S. Pat. No. 2,558,465 granted to P. M. Seymour on June 26, 1951, another combined table and bench assembly is disclosed. This table and bench assembly relies heavily on chainlike tension members for stiffness which members are heavy. Also, the nature of the assembly is such that the table in the Seymour assembly will note be as stable as is required for normal dining use. Likewise, in U.S. Pat. No. 2,647,562 granted to C. F. Hoffar on Aug. 4, 1953, a combined collapsible table and seat assembly is disclosed. However, the Hoffar structure also includes complex linkages and requires a large number of independent operations for opening and closing the assembly. In addition, the Hoffar assembly includes linkages which preclude access from the sides of the benchlike seats and thereby render the assembly difficult to use. Post U.S. Pat. No. 2,991,829 granted on July 11, 1961 likewise discloses a combined collapsible table and seats. This, again, includes complex toggle linkages and requires a variety of separate and distinct operations for opening and closing the assembly. Similar limitations exist in the structures illustrated and described in French Pat. Nos. 1,054,743 and 1,092,230. In U.S. Pat. No. 3,141,424 which was granted to P. M. Seymour on July 21, 1964, yet another combined table and seat assembly is disclosed. This assembly does not collapse compactly and it also includes relatively difficult to make cam tracks in its linkage. Finally, in U.S. Pat. No. 3,256,037 granted to J. Giambaldo on June 14, 1966, yet another form of combined table and seat is disclosed. This structure is inconveniently heavy and the linkage employed therein will not yield as rigid a structure as is required.

From the review of the prior art above presented, it will be seen that there have been numerous attempts over many years to produce a lightweight, easily unfolded and folded, combined collapsible table and seat. However, each prior art proposal has fallen somewhat short of the mark. As a result, there has been no significant commercial success for any of the prior art devices known to applicants.

DETAILED DESCRPTION OF PREFERRED EMBODIMENT

Figure 1:
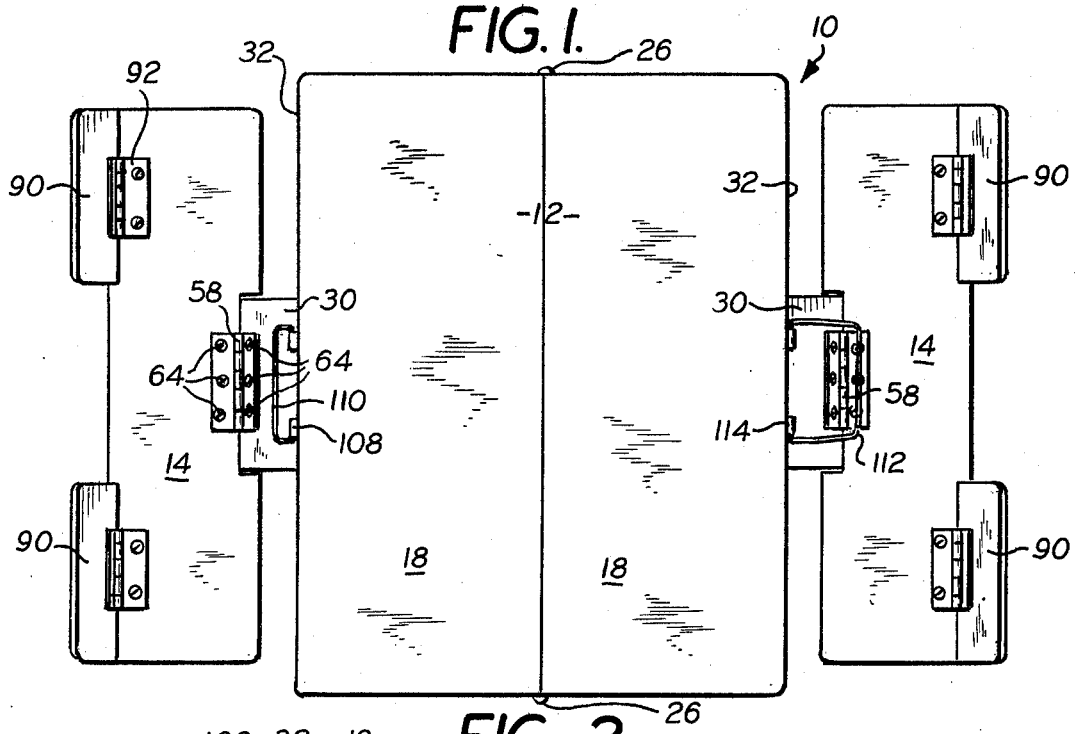
FIG. 1 is a top plan view of a combined collapsible table and seats embodying the present invention.

Referring now to the drawings in detail and particularly to FIGS. 1 to 4 thereof, a collapsible combined table and seat assembly 10 embodying the present invention is illustrated in its unfolded or usable condition. The assembly 10 comprises a collapsible table 12 and a pair of seats in the form of benches 14 disposed on opposite ends of said table and somewhat below the table. The benches 14 are connected to the table 12 by a suitable lightweight collapsible linkage 16, which linkage in its illustrated position provides a rigid support for the benches 14 and for the table 12. As will become more apparent hereinafter, included in the linkages 16 are the benches 14 themselves and the supports therefor.

The table 12 is comprised of two relatively pivotally movable table top portions 18 which may be made of any suitable material such as, for example, wood, sheet metal such as sheet aluminum, fiberboard, and, as presently preferred, fiber glass reinforced plastic. Preferably, the material is lightweight and to this end composite structures such as honeycomb cores may be employed. Extending along the opposite edges of each of the table portions 18 are vertically extending reinforcing struts 20 which overlap at the center of the table 12 and are provided in the zone of overlap designated by the reference numeral 22 with registered apertures 24 through which extend suitable pivots in any suitable form such as, for example, screws 26 or rivets. Thus, when the assembly 10 is conditioned for collapse, the two table top portions 18 can be pivoted relative to one another from the open position illustrated in FIGS. 1 to 4 in which they are in co-planar end-to-end relation and to a closed position in which they are in parallel spaced apart confronting relation. As viewed in FIG. 2, the movement of the lefthand table top portion 18 to collapse the table 12 would be counterclockwise and the movement of the righthand table top portion 18 would be clockwise. This would bring the two table top portions into their closed position in which they are in spaced apart confronting relation, as will be described in greater detail hereinafter. The struts 20 may be formed separately from the table top portions 18 and joined thereto in any suitable manner such as by the use of adhesives or by the use of securing elements such as screws or the like. In lieu thereof, each table top portion may be formed from a fiber glass reinforced plastic material or from sheet aluminum, in which event the struts 20 may readily be formed integrally with the table top portions 18.

Extending along the confronting edges of the two table top portions 18 are a pair of confronting depending cross braces 28. The braces 28 may be formed separately from the table top portions 18 and then secured thereto in any suitable manner or they may be formed integrally with such table top portions as in the formation thereof from fiber glass reinforced plastic. Such integral construction could also be employed by fabricating the table top portions and associated bracing from metal stampings or the like. The cross braces, in addition to stiffening the table top 12, also serve as stops to limit the relative pivotal movement of the two table portions 18 so that they will be in co-planar relation when opened.

Figure 5:
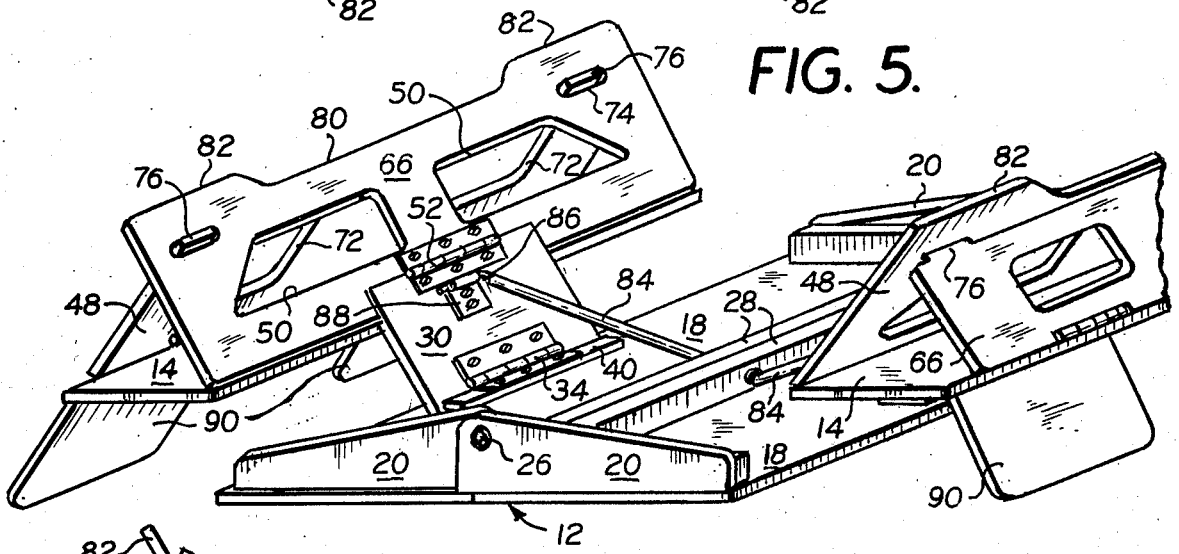
FIG. 5 is a perspective view of the assembly of FIG. 1 shown upside down, but in a fully unfolded condition and ready for use upon being turned right side up.

The linkages 16 each include a downwardly angularly exxtending central support member 30, which support members are pivotally mounted on the outer ends 32 of the table top portions 18 as by hinges 34. As best seen in FIG. 3, the hinges 34 each have one strap 36 secured to the bottom of the associated table top portion 18 adjacent the edge 32 by any suitable means such as, for example, screws 38. Clearly, other means for securing the strap 36 to the bottom of the table top portions 18 could be employed. It is desirable to underlie strap 36 with shims 40 which are illustrated in the form of elongated rectangular bars, which shims themselves may be secured to the table top portions by screws 42 or the like, as shown. The main function of the shims 40 is to provide a suitable spacing of the supports 30 from the table top portions to enable the collapsed linkages 16 to be received within the enclosed and collapsed assembly as will be described hereinafter. The shims also strengthen the connection between supports 30 and their associated table portions 18. The second hinge strap 44 of each of the hinges 34 is secured to its associated centrally disposed support 30 in any suitable fashion such as, for instance, by screws 46. As may best be seen in FIG. 5, each of the table supports 30 is in the form of a rectangular platelike member that is made of a stiff material such as wood, metal, fiberboard or fiber glass reinforced plastic. Preferably, the material is of relatively lightweight. It is the supports 30, which extend upwardly from the forward ends of the seats 14, that serve as the main loadbearing members for supporting the table top 12. Hinges 34 permit relative pivotal movement between the supports 30 and table top portions 18 between an open position shown in FIG. 2 and a closed position in which the support is substantially parallel to and in spaced confronting relation with its associated table top portion 18. Preferably, a stop is provided to prevent movement of the supports beyond their open position. As may be seen in FIG. 6, this stop is effected by the engagement of the upper end of support 30 with the bottom surface of table top portion 18. Of course, other types of stops may be employed.

The lower ends of the members 30 are connected to the main legs 48 for the seats 14.

Figure 8:
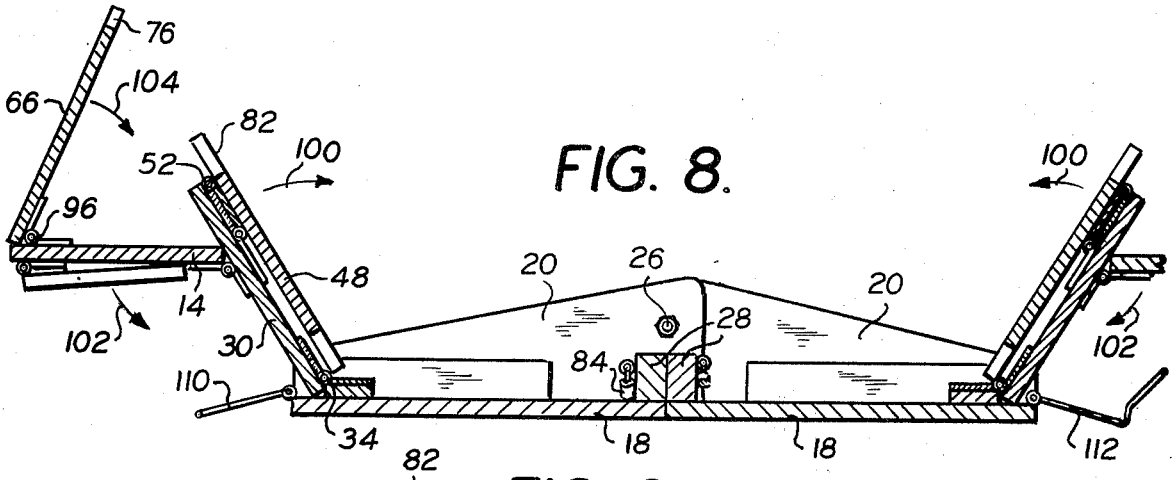
FIG. 8 is a view similar to FIGS. 6 and 7, but showing the assembly in still a further collapsed or folded condition.

Each of the legs 48 is preferably, although not necessarily, a stiff platelike member made of any suitable material such as wood, metal, fiberboard, fiber glass reinforced plastic or the like. Preferably, the material from which the member 48 is made, and all of the materials employed herein, is lightweight and of great rigidity. To further lighten the weight of the legs 48, which extend substantially the full width of the seats 14, the legs are provided with weight saving cut-outs 50 as shown. The support members 30 are connected to the main legs 48 by a suitable pivotal connection such as, for example, hinges 52 having upper straps 54 connected to the inner surfaces of the supports 30 and lower straps 56 connected to the inner surfaces of the main legs 48. Any suitable mode of connecting the hinge straps 54 and 56 to the supports 30 and legs 48 may be employed, such as, for example, screws, rivets, adhesives, soldering or welding or the like as may be appropriate. Clearly, the choice of such connection means for this connection and for all other similar connections throughout the structure will be dependent in a large degree on the nature of the materials being employed. Hinges 52 permit movement between support 30 and main legs 48 to an open position shown in FIG. 2 in which the two members are co-planar and a closed position in which said members are in parallel close confronting relation (FIG. 8). A stop is included to prevent movement of the members beyond their open position which stop is preferably part of the structure of hinges 52 themselves.

The supports 30 are also pivotally connected to their associated seats 14. The pivotal connections between the parts 30 and 14 are located above the pivotal connections between the parts 30 and 48 as may be seen best in FIG. 2. As shown herein, the pivotal connections between the supports 30 and the seats 14 are yet other hinges 58 in which one strap 60 is secured in any suitable manner to the outer surface of the support 30 and the other strap 62 is secured to the upper surface of the seat 14 in the center thereof. As shown, the manner of connection is by means of screws 64, although, clearly, other suitable connecting means may be employed.

Figure 9:
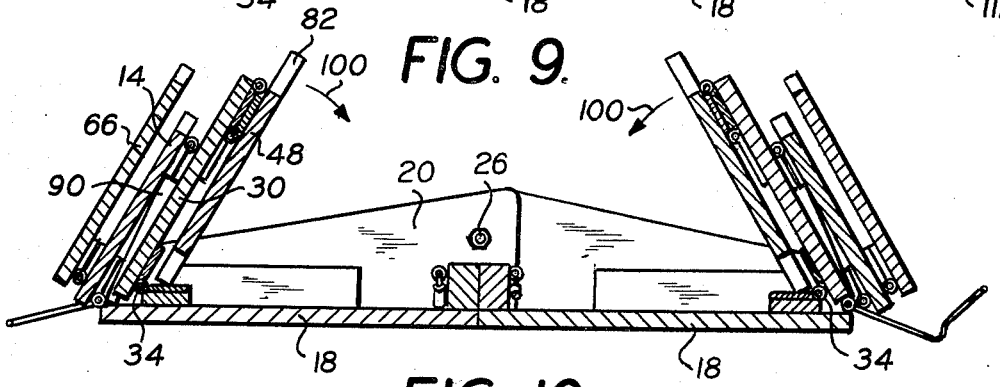
FIG. 9 is a view similar to FIGS. 6 through 8, but showing the seat portions of the assembly completely folded.

Hinges 58 permit relative movement between supports 30 and seats 14 to an open position in which the seats are horizontal (FIG. 2) and a closed position in which the seats are in substantially parallel confronting relation with supports 30 (FIG. 9).

Figure 2:
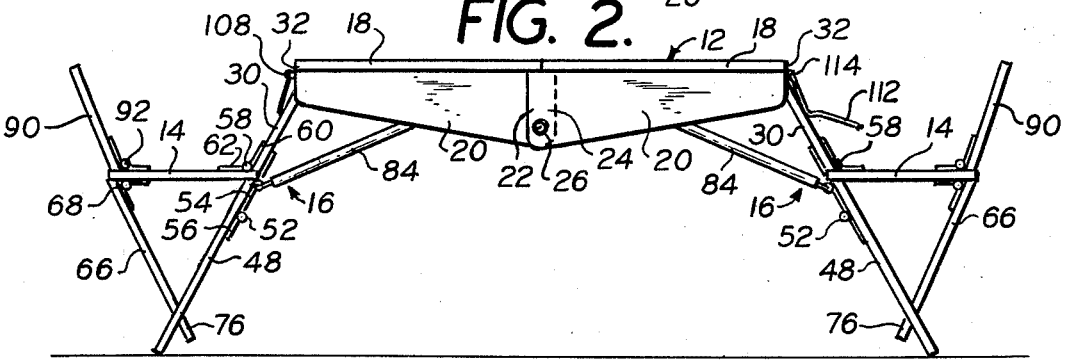
FIG. 2 is a side elevational view thereof.
Figure 3:
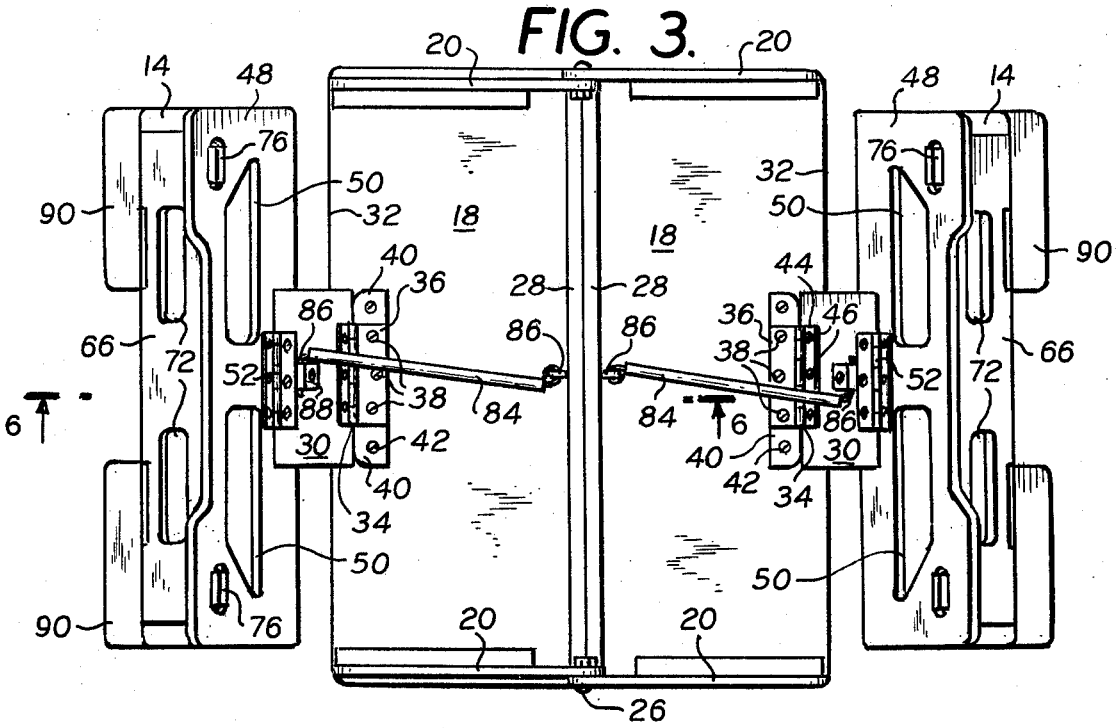
FIG. 3 is a bottom plan view thereof.
Figure 4:
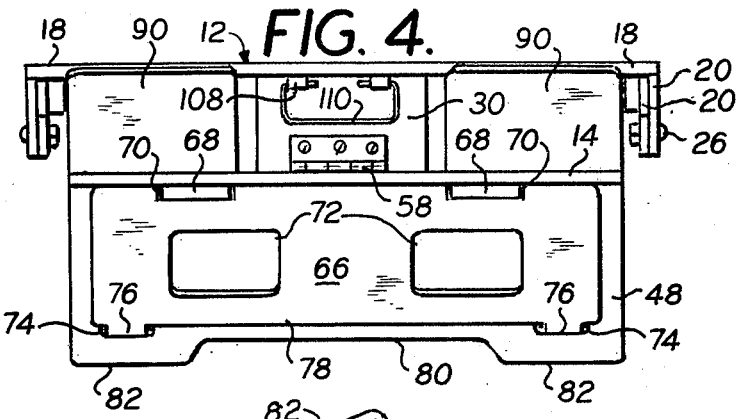
FIG. 4 is an end elevational view thereof.

To support the seat 14 in the horizontal position shown in FIG. 2 when the assembly 10 is in its unfolded condition and ready for use, yet another platelike leg member 66 is included in each of the linkages 16. The leg members 66 are pivotally connected to the outer edges of the seats 14 by any suitable means such as, for example, hinges 68 having one strap connected to the bottom surface of the seat 14 adjacent the outer edge thereof and the other strap connected to the inner surface of the legs 66 at the upper end thereof. Preferably, and as shown, the pivotal connection between seats 14 and legs 66 is distributed along the length of the joint as for example by the use of two widely spaced hinges 68 for each such pivotal joint. The manner of connection of hinges is illustrated to be by means of screws, although any other suitable connecting mechanism may be employed. Hinges 68 permit movement between said other legs 66 and the seats 14 between an open position in which legs 66 extend downwardly at an angle to seats 14 (FIG. 2) and a closed position in which seats 14 and legs 66 are in close confronting substantially parallel relation. While the leg members 66 are preferably (although not necessarily) rectangular platelike members made of any suitable lightweight rigid material such as wood, metal, fiberboard, fiber glass reinforced plastic or the like, it is not wholly rectangular as may be seen best in FIG. 4. For example, along the upper edge of each of the leg members 66 there are a pair of cut-outs 70 to accommodate the hinges 68 which pivotally mount the leg members 66 to the seats 14. In addition, the leg members 66 may be provided, as shown, with weight saving cut-outs 72. To rigidify the support for the seats 14, means are provided for detachably connecting the leg members 66 to the leg members 48 in order to provide a stable triangular support for each of the seats, said triangular support including, of course, the seats 14 themselves. The means for effecting this detachable connection between the legs 66 and the legs 48 include one or more slits 74 in each of the leg members 48, here shown as two in number. Associated with each of the slits 74 is a downwardly extending or depending tab 76 on the bottom edge of each of the leg members 66, which tabs are registrable with the slits 74 in the associated legs 48 and are receivable therein. When the tabs 76 are disposed within their associated slits 74, the lower edge 78 of the leg supports 66 will bear against the legs 48 to form a rigid triangular support for each seat 14. To further save weight in the assembly 10 and to provide for a more stable support for each seat 14, preferably, the lowermost central portion of the leg members 48 are removed to form an elongated recess 80 along the bottom edge, whereby to cause only two relatively short portions 82 of the bottom of the leg support 48 to bear against the ground, floor or other supporting surface.

With the two seats 14 provided with rigid ground supports as described, and with the central table support 30 extending upwardly at angles to hold up the table 12, a satisfactory collapsible table assembly is provided. However, additional bracing or stiffening members are provided in the linkage 16 to support both halves 18 of the table 12 with the same type of triangular rigid support structure as is employed for the seats 14. As shown, the additional members in the linkage 16 are two bracing rods 84 which extend between the bottoms of the table top portions 18 and the bottoms of the support members 30. As may best be seen in FIG. 3, the bracing members 84 are rodlike in form and are pivotally mounted as for example by a pair of interengage eyes 86 connected to rods 84 and adjacent the transversse struts 28 for omnidirectional pivotal movement. The outer ends of each of the rods 84 are hooked at right angles to the longitudinal axis of the rods, the hooked end portions being designated by the reference numerals 86. Disposed adjacent the upper edge of the upper strap of each of the hinges 52 which connect the support members 30 to the main leg 48 is a tubular member 88 which is preferably of substantial longitudinal extent, say, for example, at least a half an inch. However, an ordinary eye could be employed without departing from the invention. The passage in each of the tubes 88 is proportioned to receive the right angle hooked ends 86 of the rods 84, wheereby to fix the hooked ends 86 to the main table supports 30. When the rods are so hooked, then the table top portions 18 form a rigid triangular structure to insure that each table top portion 18 will be rigidly held against pivoting or any other substantial movement in use.

While the use of the bracing rods as above-described is the preferred form of bracing to rigidify the support for the table 12, various modifications may be made therein without departing from this invention. Thus, for example, the tubular members 88, rather than being disposed on the support members 30 as described, could instead be disposed on the main legs 48, for example, just beneath the lower straps of the hinges 52. This shift would, of course, require that the rods 84 be longer, but apart from that, the same rigidifying effect would be achieved. Alternatively, rather than using the rods 84 with their detachable hooked ends 86, a toggle-like brace could be substituted with one end of the toggle being permanently pivotally secured to the bottom of each of the table top portions 18 and the other end of the toggle being permanently pivotally secured in the location now set aside for the tubular members 88. In such an instance, the toggle would, of course, collapse when appropriately broken in a way that is well known to the skilled art worker.

Desirably, although not necessarily, each of the seats 14 is provided with a pair of backs 90 in the form of substantially square platelike members made of any suitable lightweight rigid material as heretofore mentioned by way of example, which backs are each pivotally mounted on the seats 14 as by hinges 92 for pivotal movement between an open or upstanding position as shown in FIG. 2 in which they serve as back rests and a closed or folded position in which they are in close confronting relation with seat 14. Stops are included to prevent the back rests from going beyond the defined open position which stops, as shown, are effected by the engagement of the lower ends of the back rests with the seats. The vertical extent of the seats 90 should preferably not exceed the horizontal extent of the seat 14. As already mentioned, the back rests 90 are optional and may be deleted without departing from this invention.

From the foregoing description, it will be seen that the collapsible chair and table assembly 10 when fully unfolded or open and with the linkages 16 in their connected rigid condition will provide an extremely rigid support structure for both the seats 14 and the table 12. Moreover, the table 12 will be rigidly located between the supporting seats 14. In addition, in the embodiment shown in FIG. 1, it is to be noted that the only portion of the linkage 16 extending between the table top 12 and the seat 14, that is supports 30, is preferably located in the center of both the table top and the seat whereby to permit the users of the device to slide in from the sides, thereby obviating the necessity of crawling over the seats to be seated at the table. Thus, in assembled condition, the assembly 10 is extremely convenient to use.

As noted throughout this specification, the assembly 10 is collapsible. All of the structure for effectuating the collapse has been described but the mode of use of the assembly to collapse it and to unfold it will now be described. While the sequence of steps hereinafter described for folding up the assembly 10 is the presently preferred sequence, it will be obvious to anyone skilled in the art that a variety of sequences for collapsing the assembly is available and the use of any of them is deemed to be within the contemplation of this invention. Thus, the following description is exemplary of the preferred form of collapsing the assembly, but is clearly not the only manner in which this may be achieved.

Figure 6:
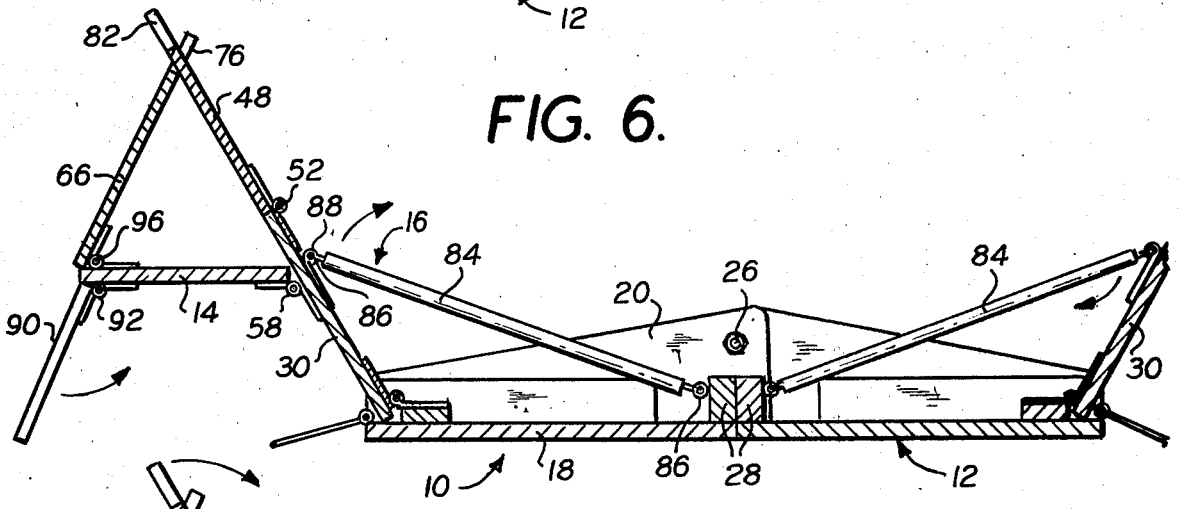
FIG. 6 is a sectional view taken along the line 6—6 in FIG. 3.
Figure 7:
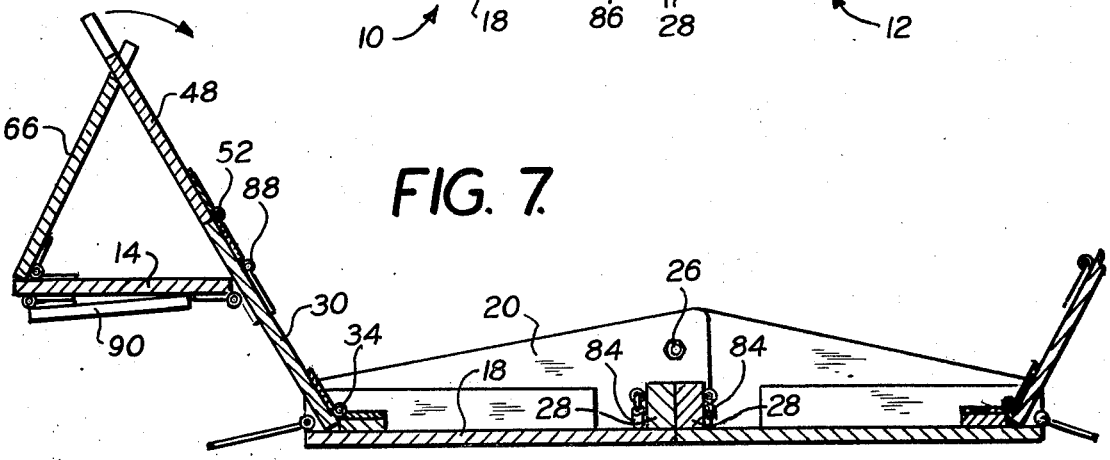
FIG. 7 is a view similar to FIG. 6, but showing the seat backs in a folded position and the bracing links folded away.

Preferably, although not necessarily, the first step in collapsing the assembly 10 is to turn it upside down so that the table top rests on the ground, floor or other supporting surface. This position is shown in FIG. 6 wherein the assembly 10 is still in assembled or open condition. The next step in collapsing assembly 10 is to fold the back rests 90 into a closed position confronting the seats 14 as may be seen in FIG. 7. Just before or after the back rests are folded down, the hooked ends 86 of the bracing rods 84 are unhooked form the tubular members 88 and are swung into a position parallel to the edge braces and stops 28 as may also be seen in FIG. 7.

As may best be seen by reference to the left side of FIG. 8, the main leg supports 48 are then swung about their hinges 52 to bring those leg supports into their closed position in confronting relation with the members 30. This is effected by first detaching the tabs 76 on the ends of the leg members 66 from the slits 74 in the main leg supports 48. The supports 30, together with their associated close confronting legs supports 48, are then swung in the direction of the arrows 100 in FIGS. 8 and 9 to the intermediate position shown in the FIG. 9 in which position the seats 14 may be swung in the direction of the arrows 102 to bring the seats into their closed position in confronting relation with the opposite surfaces of the supports 30 from the legs 48. Then the other legs 66 may be pivoted about the hinges 96 in the direction of the arrows 104 to bring the seat assembly to the direction of the arrows 104 to bring the seat assembly to the condition of FIG. 9, wherein all of the main links save for the rods 84 are in their closed positions in close confronting substantially parallel relationship. In that position, the entire collapsed seat assemblies may be pivoted about the hinges 34 from the positions shown in FIG. 9 to the closed positions shown in FIG. 10 wherein each of the seat subassemblies lies substantially parallel to its underlying and associated table portion 18. A perusal of FIG. 10 will demonstrate the desirability for inclusion of the shims 40 underlying the hinges 34 in order to provide for a co-planar confronting relationship between the leg members 48 and the undersurface of the associated table portion 18.

Figure 10:
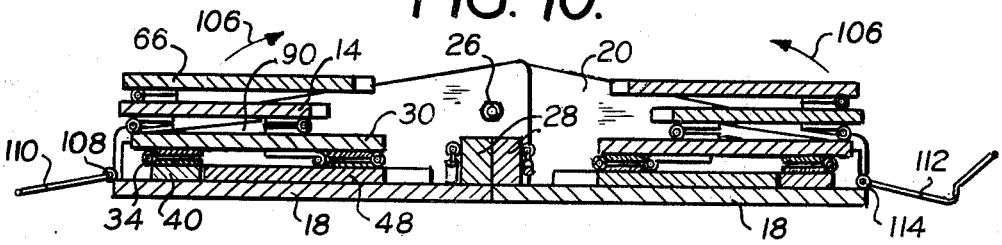
FIG. 10 is a view similar to FIGS. 6 and 9, but showing the folded seat portions folded against their associated foldable table halves.

Once the assembly 10 has been collapsed to the condition shown in FIG. 10, all that need be done is to pivot the two halves of the table top 12, that is the two table top portions 18 about their central pivot 26 in the direction of the arrows 106 whereby to move the two table top portions 18 into their closed position in spaced apart parallel relation encasing or enveloping the seats 14 and the support linkages 16 hereinbefore described. This folded condition is shown in FIG. 11.

Figure 11:
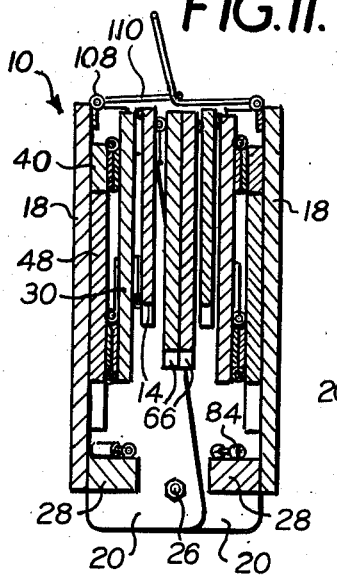
FIG. 11 is a view similar to FIGS. 6 through 10, but showing the assembly in a completely folded condition and ready for carrying or storage.
Figure 12:
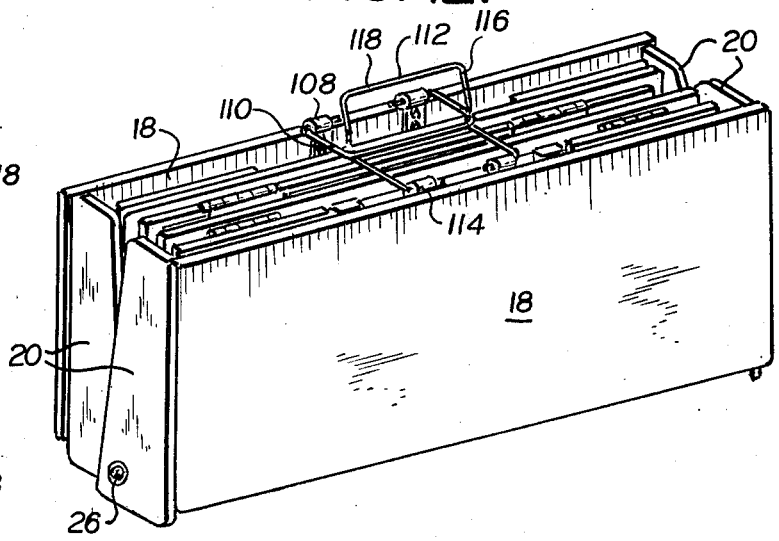
FIG. 12 is a perspective view of the assembly in the condition illustrated in FIG. 11.

To facilitate the holding of the assembly 10 in the position illustrated in FIG. 11, a suitable latch is provided as well as a handle for carrying the assembly 10. As best seen in FIGS. 11 and 12, the latch and handle are preferably combined in one structure, although, clearly, the two functions could be performed by two separate structures. Specifically, as shown in FIGS. 11 and 12, pivotally connected to one of the table top portions 18 at the outer edge thereof as at 108 is a U-shaped wire member 110 which is proportioned to receive within it a second U-shaped wire member 112 that is bent at its center into an L shape. The other end of the member 112 is pivotally mounted on the outer edge of the opposite table top portion 18 as at 114. With the upstanding portion 116 of the bent U-shaped member 112 extending upwardly between the legs of U-shaped member 110, the entire collapsed assembly can be carried by using a bight 118 of the folded U-shaped member 112 as a handle. In the closed condition shown in FIGS. 11 and 12, the entire assembly 10 is sufficiently compact to fit easily within the trunk of an automobile for transport. Additionally, the structure is readily storable in the closet of a schoolroom or the like if such use is made of the assembly 10.

To reopen the assembly 10, a reverse series of the steps above-described may be employed.

Figure 13:
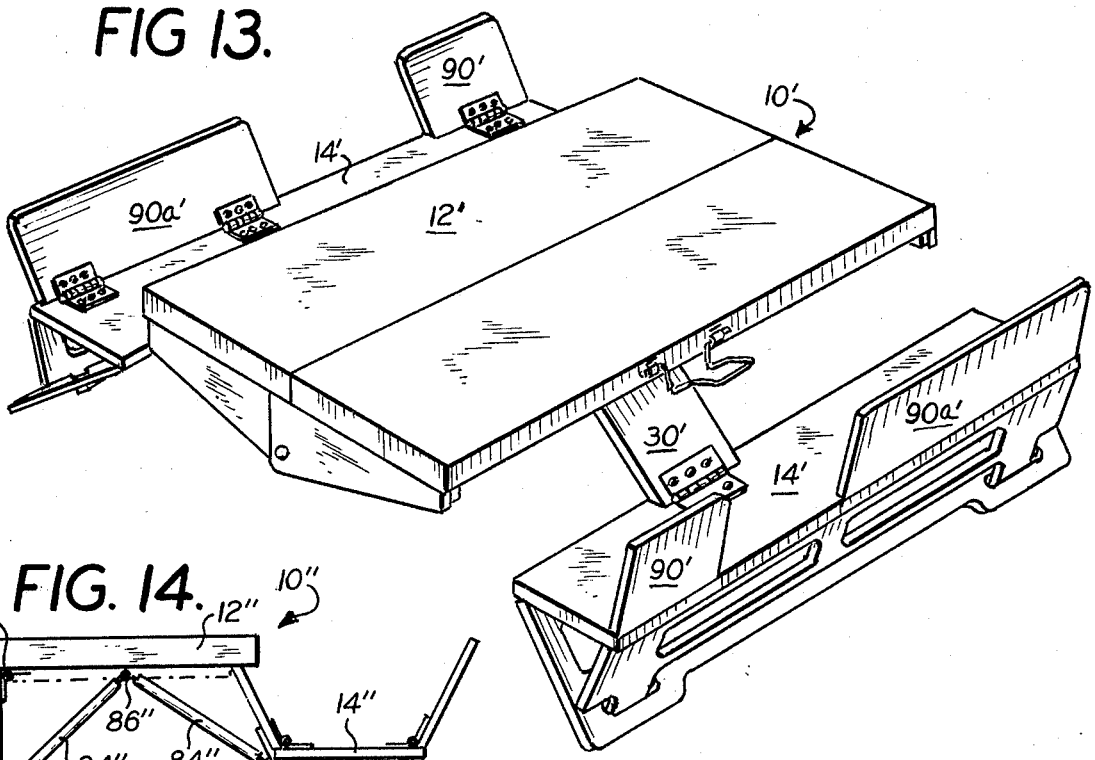
FIG. 13 is a perspective view of a modified form of combined table and seat assembly embodying the present invention.

Referring now to FIG. 13, a modified form of collapsible combined table and seat assembly 10' is shown. The assembly 10' illustrated in FIG. 13 is in all respects identical with the assembly 10 in FIGS. 1 through 12 hereinbefore described, save as noted hereinafter. Specifically, the assembly 10' illustrates that the invention does not contemplate limitation to a table with seats for only four persons. Thus, in the FIG. 13 embodiment, the assembly 10' is proportioned so that the seats 14' may accommodate three persons each, whereby to seat a total of six persons about the table 12'. If back rests are employed, three separate back rests 90' may be provided on each side of the table. As shown, however, there are only two back rests on each side, one back rest 90' being suitable for use by one person and the other back rests 90*a'* being suitable for use by two persons. The main support members 30' engage the seats 14' at a location between the back rests 90' and 90*a'* so that they minimize interference with the users seating themselves without having to climb over the benches 14'.

Figure 14:
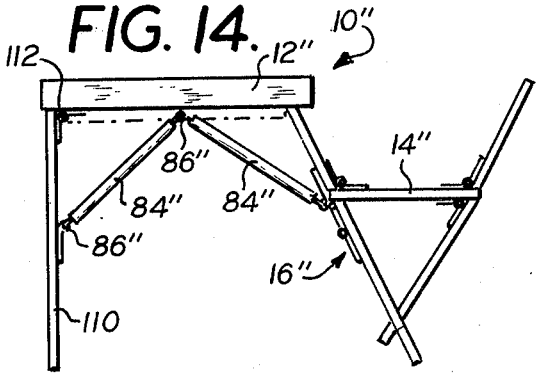
FIG. 14 is a side elevational view of yet another modified form of the present invention.

Referring now to FIG. 14, still another form of the invention is illustrated. This form of the invention, while useful for outdoor picnicing and the like, is particularly suitable for household use and for school use. In the structure of FIG. 14, the assembly is designated by the reference numeral 10'', which assembly includes a seat 14'' only at one end of the table 12''. Seat 14'' may be proportioned for one, two, or more persons and if it can accommodate at least two, the supports 30 are preferably connected to seat 14'' in between two seat locations as in assemblies 10 and 10' above described. The manner of supporting the seat 14'', that is the linkage 16'', is in all respects identical with the linkages 16 in the FIG. 1 embodiment. To support the opposite end of the table 12'', a collapsible rigid leg 110 is provided, which leg is pivotally connected to the bottom of the table 12'' by a hinge or preferably several spaced apart hinges 112. A detachable brace 84'' extends from about the center of the bottom of the table 12'' to some intermediate point on the leg 110 where it is detachably connected as by a tubular member 88'' in the same manner as hereinbefore described for the corresponding parts in assembly 10. When it is desired to collapse the assembly 10'', the seat 14'' and its associates linkage 16'' are collapsed in the exact same manner as the same parts are collapsed in the FIG. 1 embodiment. With respect to the rigid support leg 110, all that need be done is to detach the link 84'' from the tube 88'' on the leg 110 and swing the link out of the way, whereby to permit the pivoting of the leg 110 from the solid line position in FIG. 14 to the dotted line position in said figure. Desirably, the leg 110 is a rigid platelike member provided with central cut-outs to reduce the weight and to prevent interference between the folded leg 110, the folded links 84'' and their table mountings 86''. Clearly, the assembly 10'' would have many important household uses, especially for children, as well as important uses in schools, auditoriums, convention centers and the like. Of course, it also has outdoor uses as well.

Figure 15:
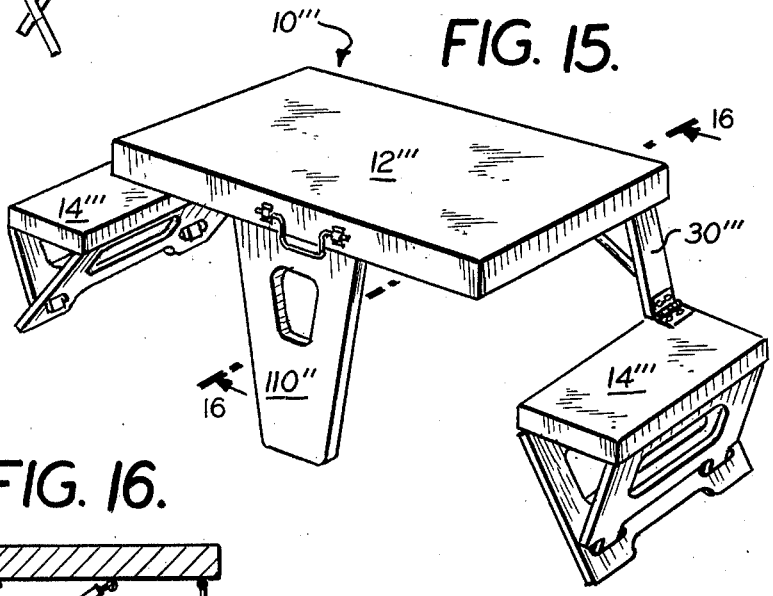
FIG. 15 is a perspective view of still another embodiment of the present invention.
Figure 16:
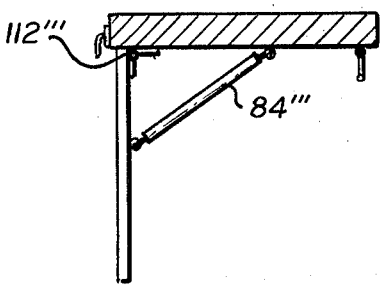
FIG. 16 is a sectional view taken along the line 16—16 in FIG. 15.

Referring now to FIGS. 15 and 16, still another modification of the invention is illustrated wherein the collapsible table and seat assembly is designated by the reference character 10'''. The assembly 10''' is in all respects identical with the assembly 10 of FIG. 1, save for the following differences. First, it will be seen that the table 12''' is not foldable, but is a unitary rigid piece. However, if desired, it may be collapsible in the same manner as the FIG. 1 embodiment. The second difference is that the seats 14''' are proportioned for use by one person only and this results in the support member 30''' being provided at one side of said seats rather than at some point intermediate the two seat ends. However, the user can slide in from the opposite side from the supports 30''.

Since the table top 12''' is supported only adjacent one side thereof, it is desirable that a suitable support be provided at the other side. As shown herein, that support is a leg 110''' which is generally similar to the leg 110 in the FIG. 14 embodiment, although preferably of lesser width than the leg 110. Apart from that difference, it will be seen that it is mounted in the same way, that is, by a hinge 112''' and is braced by a suitable brace 84''' in the same manner as the brace 84'' braces the leg 110 of the FIG. 14 embodiment. The manner of knocking down and opening up the assembly 10''' will be obvious to anyone skilled in the art who has read the foregoing specification.

Thus, it will be seen that the present invention has a wide variety of embodiments which are eminently suitable to a number of different applications. Thus, for example, the FIG. 1 and FIG. 13 embodiments are especially suited for outdoor use, although they have application indoors in schools, auditoriums and the like. The FIG. 14 embodiment is particularly useful for school classrooms and for home use, especially for children, as is the FIG. 15 embodiment hereinbefore described. However, each of these embodiments, although they may have an indicated special use, may be used outdoors or in any other fashion deemed suitable by the user without departing from the invention.

While we have herein shown and described the preferred forms of this invention and have suggested a variety of modifications therein, other changes and modifications may be made therein within the scope of the appended claims without departing from the spirit and scope of this invention.

What is claimed is:

1. In a collapsible combined table and seat of the type wherein said seat and table are relatively pivotally movable between an open position wherein said table and seat are horizontal and the front edge of said seat is disposed adjacent and below one end of said table and a folded position wherein said seat is in confronting substantially parallel relation with said table, an improved collapsible linkage for supporting said table and seat in said open posiiton and for permitting said pivotal movement to said folded position, said linkage comprising:

a support member pivotally mounted at one end thereof to said table adjacent said one end of said table for movement between an open position in which said support member extends downwardly from said table and a closed position in which said support member is in confronting parallel relation with the bottom surface of said table;

a main leg, said main leg being pivotally connected to the end of said support member opposite said one end thereof for movement between an open position in which said main leg and said support member are in substantially co-planar end-to-end relation and a closed position in which said main leg and support member are in close confronting substantially parallel relation, whereby when said support member and said table are in their open position and said support member and said main leg are in their open position, said main leg extends downwardly away from said table, and when said table, said support member and said main leg are in their respective closed positions, said main leg is in close confronting parallel relation with the bottom of said table and between the bottom of said table and said support member;

hinge means for pivotally mounting said seat on said support member intermediate the two ends of said support member for relative pivotal movement between an open position in which said seat extends outwardly away from said support member and substantially parallel to said table and a closed position in which said seat is in close confronting parallel relation with said support member adjacent the surface of said support member opposite the surface which confronts said main leg when said main leg and said support member are in their respective closed positions;

another leg member, said other leg member being pivotally mounted along one edge thereof on said seat adjacent the rear edge of said seat for movement between an open position in which said other leg member extends downwardly from said seat toward the bottom of said main leg when said main leg is in its open position relative to said support member and a closed position in which said other leg is in close confronting substantially parallel relation with the bottom of said seat; and means for detachably connecting said other leg to said main leg when all the elements of said linkage are in their respective open positions.

2. The collapsible combined table and seat as defined in claim 1, further comprising a collapsible brace operable to a bracing position wherein said brace rigidly extends between a point on the bottom of said table remote from said one end of said table and a point on a member of said linkage taken from the class consisting of said support member of said main leg when said support member, said main leg and said table are in their respective open conditions, whereby to prevent pivotal movement between said table, said support and said main leg, said support being operable to a non-bracing position to permit pivotal movement between said table, said support and said main leg.

3. The collapsible combined table and seat as defined in claim 2, wherein said collapsible brace is a rigid rod detachably conected at one end.

4. The collapsible combined table and seat as defined in claim 3, wherein said rod is pivotally connected at its other end.

5. The collapsible combined table and seat as defined in claim 4, wherein said rod is pivotally connected on said table and detachably connected to said member of said linkage taken from the class consisting of said support and said main leg.

6. The collapsible combined table and seat as defined in claim 5, wherein said rod is detachably connected to said support.

7. The collapsible combined table and seat as defined in claim 1, further comprising collapsible means for supporting the other end of said table.

8. The collapsible combined table and seat as defined in claim 1, wherein said table comprises two like table portions, and means for pivotally connecting said two table portions for movement between an open position in which said two table portions are in end-to-end coplanar relation and a closed position in which said two table portions are in substantially parallel spaced apart confronting relation, and wherein there is a seat for each end of said table, and wherein there is an improved collapsible linkage connecting each one of said seats to the adjacent one of said table portions.

9. The collapsible combined table and seat as defined in claim 8, further comprising stop means for preventing relative pivotal movement of said two table portions from said closed position to a position beyond said open position.

10. The collapsible combined table and seat as defined in claim 9, wherein said stop means comprise a pair of transverse members depending from said table portions along the ends thereof which are in end-to-end relation when said table in its open position.

11. The collapsible combined table and seat as defined in claim 10, wherein said transverse members extend along substantially the full extents of said table ends.

12. The collapsible combined table and seat as defined in claim 8, further comprising a collapsible brace for each linkage, each brace being operable to a bracing position wherein said brace rigidly extends between a point on the bottom of said table portions associated therewith at a point adjacent the end thereof which is in end-to-end relation with said other table portion and point on a member of the associated linkage taken from the class consisting of said support member and said main leg when said support member, said main leg and said table are in their respective open conditions.

13. The collapsible combined table and seat as defined in claim 12, wherein said collapsible braces are rigid rods pivotally connected to said table members and detachably connected to said support members.

14. The collapsible combined table and seat as defined in claim 1, wherein said seat is an elongated bench having seating locations for at least two persons, and said support member is pivotally connected to said bench between two of said seating locations.

15. The collapsible combined table and seat as defined in claim 13, wherein said seats are elongated benches each having seating locations for at least two persons, and said support members are pivotally connected to their associated bench between two of said seating locations.

16. The collapsible combined table and seat as defined in claim 1, wherein said means for connecting said other leg to said main leg comprises a tab on said other leg, said main leg having a slit for receiving said tab.

17. The collapsible combined table and seat as defined in claim 1, wherein said main leg and said other leg are platelike members of length substantially equal to the length of said seat, and wherein said means for connecting said main leg to said other leg comprises a tab extending outwardly in the plane of said other leg from the edge of said other leg which is opposite to said one edge of said other leg, said main leg having a slit therein adjacent the end thereof which is remote from said support member when said main leg and support member are in their open positions, said slit being proportioned to receive said tab therein.

18. The collapsible combined table and seat as defined in claim 8, wherein said main leg and said other leg in each linkage are platelike members of length substantially equal to the length of their associated seats and wherein said means for connecting each of said main legs to its associated other leg comprises a tab extending outwardly in the plane of said other leg from the edge of said other leg which is opposite to said one edge of said other leg, said main leg having a slit therein adjacent the end thereof which is remote from said support member when said main leg and support member are in their open positions, said slit being proportioned to receive said tab therein.

19. The collapsible combined table and seat as defined in claim 13, wherein said main leg and said other leg in each linkage are platelike members of length substantially equal to the length of their associated seats, and wherein said means for connecting each of said main legs to its associated other leg comprises a tab extending outwardly in the plane of said other leg from the edge of said other leg which is opposite to said one edge of said other leg, said main leg having a slit therein adjacent the end thereof which is remote from said support member when said main leg and support member are in their open positions, said slit being proportioned to receive said tab therein.

20. The collapsible combined table and seat as defined in claim 7, wherein said collapsible means for supporting said other end of said table is a rigid leg pivotally mounted on said table adjacent said other end for movement to an open position in which said rigid leg depends from said table and to a closed position in which said rigid leg is in parallel confronting relation with said table.

21. The collapsible combined table and seat as defined in claim 20, and further comprising a collapsible brace operable to a bracing position in which it rigidly extends between the bottom of said table and a point on said leg intermediate its two ends at an angle to both for preventing relative pivotal movement between said rigid leg and said table, and a non-bracing position to permit relative pivotal movement between said table and said rigid leg.

22. The collapsible combined table and seat as defined in claim 21, wherein said collapsible brace is a rigid rod detachably connected at one end.

23. The collapsible combined table and seat as defined in claim 22, wherein said rod is pivotally connected at the other end.

24. The collapsible combined table and seat as defined in claim 7, wherein said collapsible means for supporting the other end of said table comprises a second seat at said other end of said table, and a second of said linkages for supporting said second seat and the other end of said table.

25. The collapsible combined table and seat as defined in claim 24, wherein the support members in each of said linkages are connected to said table and their associated seats along one side thereof, a rigid leg for supporting the other side of said table, and means for positioning said leg in an open position in which it depends from said table and in a closed position in which it is in substantially parallel confronting relation with said table.

26. The collapsible combined table and seat as defined in claim 25, and further comprising a collapsible brace operable to a bracing position in which it rigidly extends between the bottom of said table and a point on said leg intermediate its two ends at an angle to both for preventing relative pivotal movement between said rigid leg and said table, and a non-bracing position to permit relative pivotal movement between said table and said rigid leg.

27. The collapsible combined table and seat as defined in claim 26, wherein said collapsible brace is rigid rod detachably connected at one end.

28. The collapsible combined table and seat as defined in claim 27, wherein said rod is pivotally connected at the other end.

* * * * *